United States Patent [19]

Tuomikoski

[11] Patent Number: 4,792,380

[45] Date of Patent: Dec. 20, 1988

[54] FASTENING OF A PROFILE BAR TO AN ADJUSTMENT SPINDLE IN A HEAD BOX

[75] Inventor: Tapani Tuomikoski, Jyväskylä, Finland

[73] Assignee: Valmet Oy, Finland

[21] Appl. No.: 130,888

[22] Filed: Dec. 10, 1987

[30] Foreign Application Priority Data

Dec. 12, 1986 [FI] Finland ..... 865085

[51] Int. Cl.[4] ..... D21F 1/02

[52] U.S. Cl. ..... 162/344; 162/336

[58] Field of Search ..... 162/336, 344, 343, 346, 162/347, 259; 425/466, 381

[56] References Cited

U.S. PATENT DOCUMENTS

| | | | |
|---|---|---|---|
| 4,326,916 | 4/1982 | Flaig et al. | 162/344 |
| 4,373,993 | 2/1983 | Fujiwara | 162/347 |
| 4,517,055 | 5/1985 | Dove | 162/344 |
| 4,517,056 | 5/1985 | Roerig et al. | 162/344 |
| 4,620,899 | 11/1986 | Wolf | 162/344 |

FOREIGN PATENT DOCUMENTS

| | | |
|---|---|---|
| 34054 | 3/1964 | Finland . |
| 1585846 | 3/1981 | United Kingdom . |

*Primary Examiner*—David L. Lacey
*Assistant Examiner*—K. M. Hastings
*Attorney, Agent, or Firm*—Steinberg & Raskin

[57] ABSTRACT

Fastening of a profile bar to adjustment spindles at a discharge opening of a head box of a paper machine. A series of fastening holes or recesses are made into one edge of the profile bar and provided with chamferings. In the end of the adjustment spindles situated next to the discharge opening, a recess is provided with a series of screws being fitted in one side thereof. These screws are provided with ends coresponding to the chamferings in the fastening holes of the profile bar. A second set of screws coaxial with the first set of screws are provided in an outer wall of the recess, with inner ends of the second set of screws being provided with parts corresponding to the outer chamferings of the fastening holes in the profile bar. The inside or first set of screws can be locked in a position such that, when the profile bar is attached into connection with the inside screws by the holes and the chamferings thereof, a center plane of the profile bar coincides with an axial center plane of the adjustment spindles. The profile bar can be locked into position by the outside or second set of screws.

13 Claims, 3 Drawing Sheets

FASTENING OF A PROFILE BAR TO AN ADJUSTMENT SPINDLE IN A HEAD BOX

BACKGROUND OF THE INVENTION

The present invention concerns a fastening arrangement between a profile bar and the adjustment spindles thereof at a discharge opening of a head box in a paper machine. The profile of the profile bar is adjusted by means of the adjustment spindles, this profile determining transverse profile of the discharge opening of the head box.

A profile bar is used at an upper lip of a head box, with the profile of the discharge opening being adjusted by means of this profile bar, as is known in the prior art. For this purpose, several dozen adjustment spindles have been attached to the profile bar in the transverse direction of the headbox. The profile bar can be deflected by means of these spindles, for the purpose of adjusting the profile of the discharge opening.

High precision is required for the adjustment of the profile of the discharge opening. This is why great requirements are imposed on the fastening of the profile bar and the adjustment spindles. More and more precise adjustments of the transverse profile of grammage are needed with increasing running speeds of paper machines and with more and more strict requirements being imposed on the properties of paper. This imposes constantly increasing requirements on the means of adjustment of the profile bar.

With respect to the prior art related to the present invention, reference is made to Finnish Pat. No. 41,342 of the assignee, in which a prior art fastening of the profile bar is described in which adjusting movement of the adjustment spindles is transferred in the axial direction of the adjustment spindles eccentrically. This is why bending moments are generated in the profile bar, causing uncontrolled behavior, e.g. jerks, of the profile bar, so that the profile of the profile bar does not follow the adjusting movements of the adjustment spindles in a linear fashion.

Furthermore, certain fastening arrangements between the profile bar and the adjustment spindles are known in the prior art, in which the fastening point is situated on the axial centre line of the adjustment spindles. However, the significance of this central looation was not realized in the prior art, because the earlier requirements imposed on the adjustment of the profile bar were not equally as great as they are today. With respect to these central fastenings, reference is made by way of example, to Finnish Pat. No. 34,054, and to Finnish Patent Applications Nos. 772,145 and 810,671.

SUMMARY OF THE INVENTION

Accordingly, it is an object of the present invention to provide a new and improved fastening arrangement between a profile bar and the adjustment spindles thereof, in which fastening is symmetrical so that the detrimental moment noted above does not occur.

At the same time, it is an object of the present invention to provide such a fastening arrangement of the type concerned, which permits pivoting of the profile bar around the fastening points thereof.

It is a further object of the present invention to provide such a fastening of the type concerned, which is advantageous in view of replacement of the profile bar, so that the profile bar can be detached quickly and a new profile bar can be placed precisely in the position thereof, without complicated adjustment operations. The profile bars are naturally "consumption goods", so that attempts should be made to minimize the standstills caused by the replacement thereof.

These and other objects are attained by the present invention which is directed to a fastening arrangement in a head box of a paper machine comprising a profile bar in a discharge opening of the head box and at least one adjustment spindle for adjusting profile of the profile bar which in turn determines transverse profile of the discharge opening. The fastening arrangement for the profile bar to the at least one adjustment spindle comprises at least one recess provided in a side of the profile bar, and a recess provided in an end of the at least one adjustment spindle facing toward the discharge opening. Means for interconnecting the profile bar with the at least one adjustment spindle are provided, and are shaped substantially complementary to said at least one profile bar recess and adapted to extend into the adjustment spindle recess. The profile bar is aligned with the at least one adjustment spindle when interconnected therewith by the interconnecting means.

More particularly, a centre plane of the profile bar substantially coincides with an axial centre plane of the adjustment spindle, when aligned. The at least one profile bar recess may be chamfered. The interconnecting means preferably comprise a screw having an end shaped substantially complementary to the profile bar recess. Moreover, a pair of recesses are preferably disposed on opposite sides of the profile bar, with the interconnecting means also comprising a second screw. Both these screws have ends shaped substantially complementary to the respective recesses in the profile bar. The first screw aligns the profile bar with the adjustment spindle, while the second screw locks the profile bar into position.

Moreover, these respective recesses may extend into the profile bar and meet, to form a hole directly through the profile bar itself.

With a view to achieving the objects listed above and those which will become apparent below, the present invention is principally characterized by

- a series of fastening holes having been made into the profile bar and provided with chamfering at both sides;
- in the end of the adjustment spindles situated next to the discharge opening, a recess or equivalent having been provided, with a series of screws being fitted in one side thereof, these screws being provided with ends corresponding to the chamferings in the fastening holes in the profile bar;
- a second set of screws being positioned in an outer wall of the adjustment spindle recess and coaxial with the first set of screws, the inner ends of this second set of screws being provided with parts corresponding to outer chamferings at the fastening holes in the profile bar;
- the inside screws being lockable in a position such that, when the profile bar is attached or connected with the inside screws by means of the holes and the chamferings therein, a centre plane of the profile bar substantially coincides with an axial centre plane of the adjustment spindles, and
- the profile bar being lockable in position by means of the outside or second set of screws.

BRIEF DESCRIPTION OF THE DRAWINGS

The present invention will now be described in greater detail below, withreference to an exemplary embodiment thereof illustrated in the accompanying drawings, and to which the present invention is not intended to be strictly confined. In the drawings.

DESCRIPTION OF THE PREFERRED EMBODIMENTS

Figure 1:
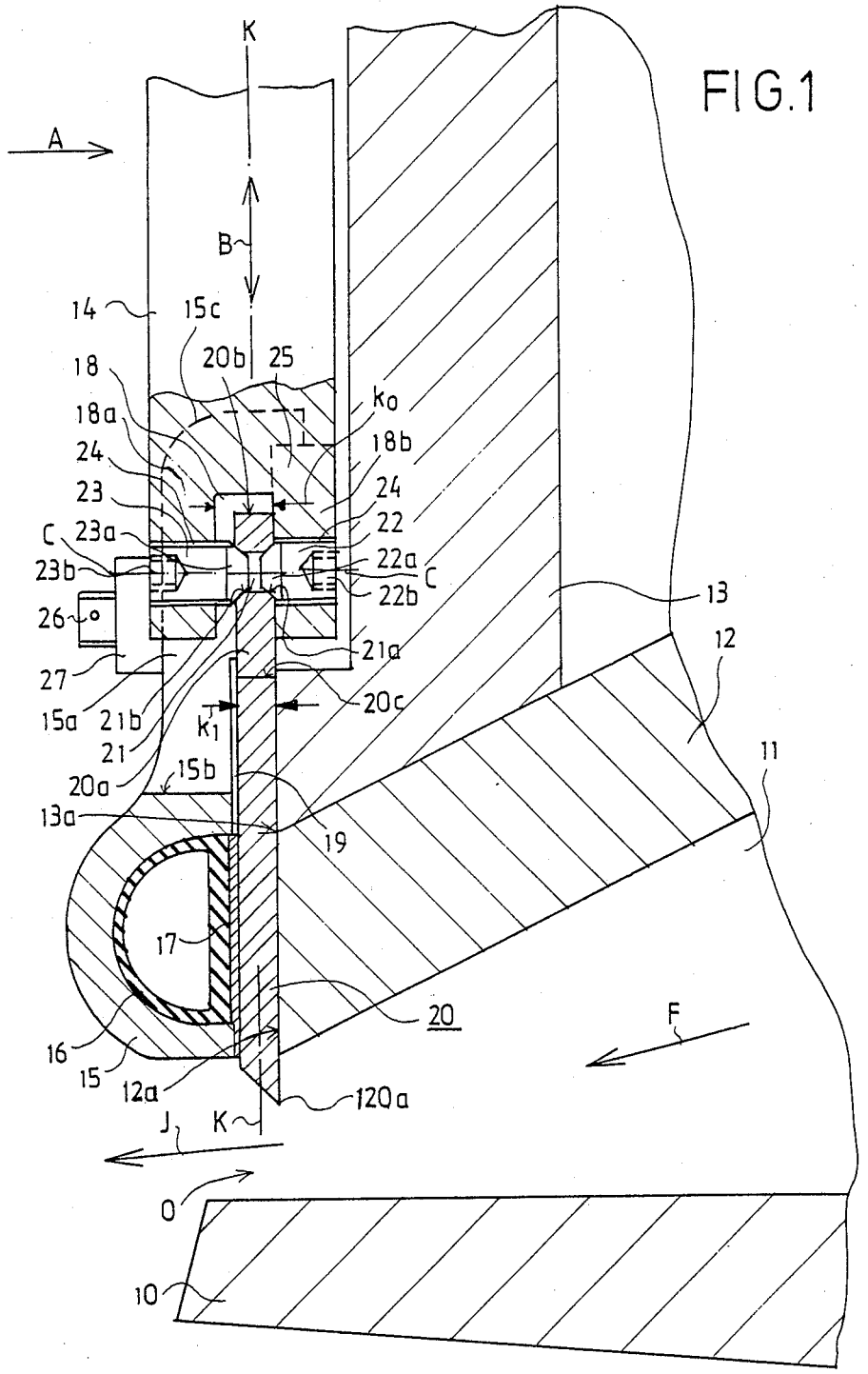
FIG. 1 is a vertical sectional view along line I—I of FIG. 2, illustrating fastening in accordance with the present invention.

A brief description of construction of the lip section in a head box, principally with reference to FIG. 1, will first be given. The lip section comprises a lower-lip wall 10 and an upper-lip wall 12, between which a discharge duct 11 is defined, which becomes narrower in the direction of flow F of the pulp suspension. The discharge opening O is defined from above, by a profile bar 20. A lower edge 120*a* of the profile bar 20 determines transverse profile of the discharge opening O. The pulp suspension jet J is discharged through the discharge opening O onto a forming wire (not illustrated in the former.

Figure 2:
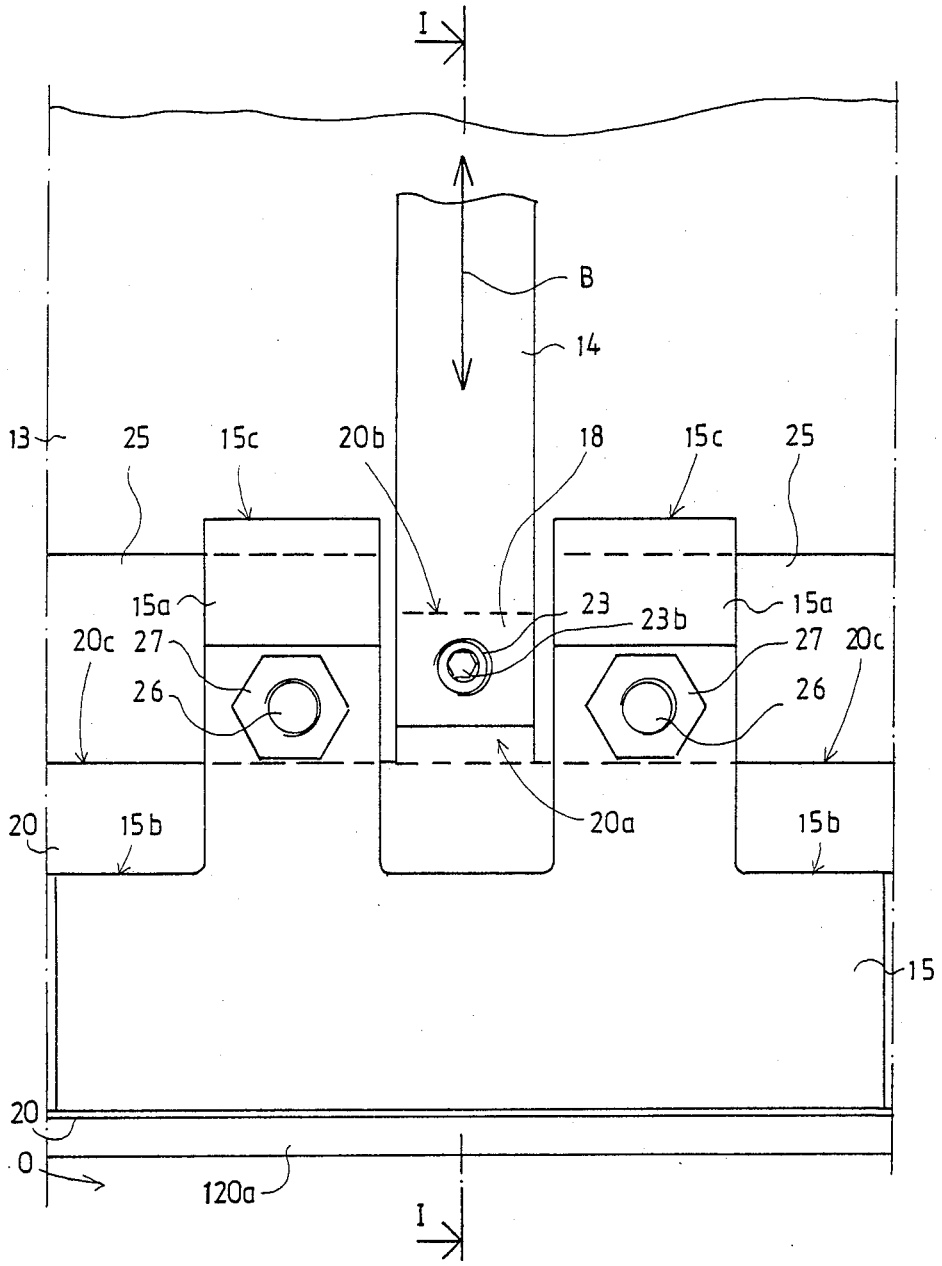
FIG. 2 is a perspective view in the direction A denoted in FIG. 1, of the fastening arrangement in accordance with the present invention.

The profile bar 20 is provided with projection parts 20*a*, having a spacing equal to spacing of adjustment spindles 14, with a top side of the projecting parts 20*a* being denoted by reference numeral 20*b*. The sides between the projecting parts 20*a* are denoted by reference numeral 20*c*. The profile bar 20 is attached through the projecting parts 20*a*, by means of fastening arrangements in accordance with the present invehtion, in recesses 18 in lower ends of the adjustment spindles 14 centrally, i.e. in plane K—K shown in FIG. 1 and in sectional plane I—I shown in FIG. 2.

The profile bar 20 is pressed against a front side 12*a* of an upper-lip plate 12, by a holder piece 15, which defines a pressure hose 16 in an interior thereof. An intermediate plate 17, which may be teflon-coated, is placed against the pressure hose 16 on the side thereof facing the profile bar 20.

The holder piece 15 is provided with projecting parts 15*a*, the top sides thereof being denoted by reference numeral 15*c*, and sides of the holder 15 between the projecting parts 15*a* being denoted by reference numeral 15*b*. The projecting parts 15*a* are supported through projecting points 25 against a front side of the front wall 13. Between the points 25 in the front wall 13, recesses have been cut facing the adjustment spindles 14. The holder piece 15 is fixed through the projection parts 15*a* thereof, by means of screws 26 and nuts 27, so as to support the profile bar 20 from outside. Moreover, in this support arrangement, the pressure-loaded hose 16 has been used for adjusting the support force.

An inner side of the support piece 15 is not pressed directly against the outer side of the profile bar 20. Rather, there is a slot space 19 between the profile bar 20 and the support piece 15, so that the profile bar 20 is pressed only through the plate part 17 by the pressure load of the hose 16. The intermediate plate 17 which may be, e.g., teflon-coated, provides a sufficiently low frictional support, so that the profile bar can be profiled sufficiently freely.

With a spacing corresponding to the spacing of the adjustment spindles 14, the projection parts 20*a* of the profile bar 20 are provided with holes 21 with conical chamfering portions 21*a* and 21*b*. The profile bar is attached to the adjustment spindles 14 in the groove portions 18 thereof, through the holes 21. For this attachment, walls 18*a* and 18*b* defining the groove portion 18 are provided with threaded holes 24, into which screws 22 and 23 are attached. The screws 22 are provided with conical ends 22*a*, and with hexagonal sockets 22*b* at the opposite end thereof. In a preliminary assembly, the screws 22 are precisely locked by means of a gauge, in a position such that the profile bar 20 becomes straight.

Afterwards, the profile bar 20 is placed in its position so that the upper end thereof becomes situated in the groove 18 and the chamfering portions 21*a* of the holes 21 become positioned in conjunction with the conical ends 22*a* of the screws 22. In other words, the inside fastening screws 22 are preliminarily fitted substantially in a position such that the inner side of the profile bar 20 becomes situated against a side 18*b* of the recess 18 in the bottom end of the adjustment spindle 14.

The screws 23 provided with conical ends 23*a* and hexagonal sockets 23*b*, are thereupon threaded into the threaded holes 24 in the wall 18*a* defining the groove 18 from outside. These conical ends 23*a* correspond to the chamfering portions 21*b* of the holes 21 in the profile bar 20. The outer screws 23 are tightened, whereby the profile bar 20 becomes correctly positioned against a side 13*a* of the front wall 13 and against a front side 12*a* of the upper-lip wall 12.

The fastening accomplished by means of the screws 22 and 23 is symmetric in the plane K—K of the central axes of the adjustment spindles 14, this plane K—K being, at the same time, the centre plane of the profile bar 20 fixed in position. Under these circumstances, when the adjustment spindles 14 are displaced in the plane K—K in the direction B, torque which would turn the profile bar 20 detrimentally, is not generated. When the profile bar 20 is pressed by means of pressure supplied into the hose 16 with an appropriately high force against the plane 12*a*, 13*a*, jerk-free and linear support and adjustment of the profile bar 20 are attained.

Width $k_0$ of the recess 18 at the lower end of the adjustment spindle 14, is dimensioned much larger than thickness $k_1$ of the profile bar 20, so that by opening the outside fastening screws 23, a worn-out or damaged profile bar 20 can be quickly detached from the recess 18 and a new profile bar 20 can be reinserted in the correct position determined by the ready-adjusted screws 22. The profile bar 20 becomes exactly positioned in the correct position when the outside screws 23 are turned to the appropriate tightness.

Even though the fastening screws 22, 23 have been described above as provided with conical ends 22*a*, 23*a*, it is possible to use corresponding spherical ends instead of the conical ends, and corresponding spherical chamferings at both sides of the holes 21 in the profile bar 20.

Figures 3, 4, 5:
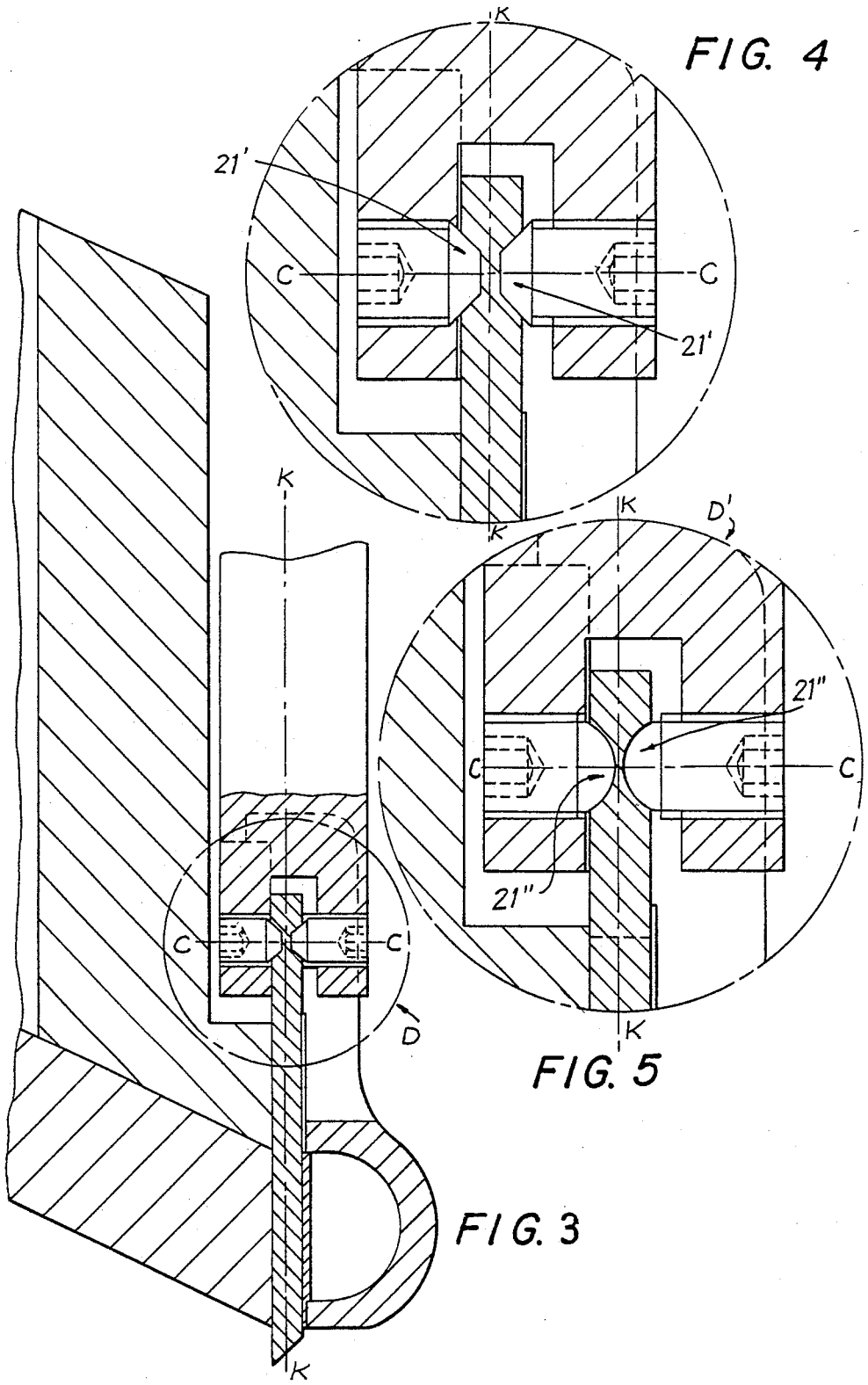
FIG. 3 is a vertical sectional view illustrating an alternative mode of fastening in accordance with the present invention.
FIG. 4 is an enlarged sectional view of are D in FIG. 3.
FIG. 5 is an enlarged sectional view of an alternative embodiment to FIGS. 3 and 4, over an enlarged sectional area D, similar to area D of FIGS. 3 and 4.

It has been described above that in the fastening arrangement of the present invention, fastening holes 21 are used, i.e. holes passing through the profile bar 20 and provided with chamferings or equivalent at the edges thereof. However, the present invention may also be accomplished so that the portions corresponding to the holes 21 do not pass through the profile bar 20, there rather, being two "recesses", (FIG. 3) e.g., provided with spherical 21'', 21'' (FIG. 5) or conical (rotational) faces, which are placed one opposite the other and which are coaxial in pairs, and which also have a common bottom (i.e. opposite sides of the narrowed bar 20 at this point). These coaxial pairs of recesses are symmetrically placed relative to the centre plane K—K of the profile bar 20, with the shape thereof being a part of a spherical face and/or of a conical face of the bar 20.

The fastening accomplished in accordance with the present invention, is also advantageous in the respect that the profile bar 20 can be pivoted with a relatively low force about fastening axes C—C determined by the centre axes of the screws 22 and 23, thereby being profiled in the position determined by the adjustment spindles 14 in linear fashion without detrimentally high and unstable counter-forces and without jerks.

The preceding description of the present invention is merely exemplary, and is not intended to limit the scope thereof in any way.

What is claimed is:

1. In a headbox of a paper machine, comprising a profile bar at a discharge opening of the headbox and at least one adjustment spindle for adjusting profile of the profile bar which in turn determines transverse profile of the discharge opening, a fastening arrangement for the profile bar to the at least one adjustment spindle, comprising a pair of recesses disposed on opposite sides of the profile bar, a recess provided in an end of the at least one adjustment spindle facing toward the discharge opening, means for interconnecting the profile bar with the at least one adjustment spindle, being shaped substantial complementary to said profile bar recesses and extending into said adjustment spindle recess, said profile bar being aligned with the at least one adjustment spindle when interconnected therewith by said interconnecting means, wherein the profile bar comprises a center plane, the adjustment spindle comprises an axial center plane, and said center plane of the profile bar substantially coincides with said axial center plane of the adjustment spindle, and wherein said interconnecting means comprise first and second screws having ends shaped substantially complementary to respective profile bar recesses.

2. The combination of claim 1, wherein at least one of said profile bar recesses is chamfered.

3. The combination of claim 1, wherein said first and second screws are substantially coaxial when extending into said adjustment spindle recesses.

4. The combination of claim 1, wherein said recesses extend into the profile bar and meet to form a hole through said profile bar.

5. The combination of claim 1, wherein said profile bar recesses are provided with conical chamferings and said first and second screws are provided with conical ends.

6. The combination of claim 1, wherein said profile bar recesses are provided with spherical chamferings and said first and second screws are provided with spherical ends.

7. The combination of claim 1, wherein said first screw is preliminarily fitted in said adjustment spindle recess in a position such that an inner side of the profile bar is situated against a side of said adjustment spindle recess in a bottom end of the adjustment spindle, when the profile bar is mounted on said first screw.

8. The combination of claim 1, wherein said spindle recess has a cross sectional width which is larger than the cross sectional width of said profile bar by a discreet distance such that it is possible to detach the profile bar from said spindle recess by opening said second screw.

9. The combination of claim 1, additionally comprising a holder for supporting the profile bar, and a pressure hose fitted in or against said holder, whereby the profile bar can be adjustably pressed against a fastening face of the headbox, depending upon pressure supplied to said pressure hose.

10. The combination of claim 9, wherein said holder is supported against a front side of the headbox and thereby supports the profile bar from outside, said pressure hose is situated within a cavity or recess of said holder, a slot is defined between an inner side of said holder and the profile bar, so that said holder is not directly pressed against the profile bar, an intermediate plate is situated between said pressure hose and the profile bar, whereby the profile bar is pressed by only the pressure from said hose, applied through said intermediate plate, and the fastening face of the headbox is the front side thereof.

11. The combination of claim 1, wherein the profile bar is substantially centrally aligned with respect to a sectional plane passing through the adjustment spindle in direction of pulp suspension flow through the headbox.

12. The combination of claim 1, wherein said at least one adjustment spindle is a plurality of adjustment spindles, each having a recess in an end thereof, and a plurality of said pair of recesses are formed in the profile bar and aligned thereon to each be situated within a respective spindle recess, when the profile bar and adjustment spindles are interconnected.

13. In a headbox of a paper machine, comprising a profile bar at a discharge opening of the headbox and at least one adjustment spindle for adjustment profile of the profile bar which in turn determines transverse profile of the discharge opening, a fastening arrangement for the profile bar to the at least one adjustment spindle, comprising a pair of recesses disposed on opposite sides of the profile bar, a recess provided in an end of the at least one adjustment spindle facing toward the discharge opening, means for interconnecting the profile bar with the at least one adjustment spindle, being shaped substantially complementary to said profile bar recesses and extending into said adjustment spindle recess, said profile bar being aligned with the at least one adjustment spindle when interconnected therewith by said interconnecting means, wherein the profile bar comprises a center plane, the adjustment spindle comprises an axial center plane, and said center plane of the profile bar substantially coincides with said axial center plane of the adjustment spindle, wherein said interconnecting means comprise a screw having an end shaped substantially complementary to one of said profile bar recesses, and wherein said pair of recesses are situated substantially coaxially and substantially symmetrically with respect to the center plane of the profile bar, with the shape of each said recess forming a part of a spherically-shaped face or a conically-shaped face on said profile bar.

* * * * *